US005333869A

United States Patent [19]

Hsun

[11] Patent Number: 5,333,869

[45] Date of Patent: Aug. 2, 1994

[54] GAME APPARATUS

[76] Inventor: Yan-Ju Hsun, 58, Ma Yuan West St., Taichung, Taiwan

[21] Appl. No.: 60,217

[22] Filed: May 10, 1993

[51] Int. Cl.[5] ..... A63F 9/08

[52] U.S. Cl. ..... 273/153 S; 273/155

[58] Field of Search ..... 273/153 S, 155, 153 R

[56] References Cited

U.S. PATENT DOCUMENTS 4,416,453 11/1983 Sasso ..... 273/155
4,427,197 1/1984 Doose ..... 273/153 S
4,500,090 2/1985 Nieto ..... 273/153 S
4,540,177 9/1985 Horvath ..... 273/153 S
5,116,052 5/1992 Pop ..... 273/153 S
5,215,305 6/1993 Hsun ..... 273/153 S

*Primary Examiner*—Vincent Millin
*Assistant Examiner*—Steven B. Wong

[57] ABSTRACT

A spherical body includes six surfaces perpendicular with one another, an opening formed in each of the six surfaces, a cap including a shaft for engaging with the opening of each of the six surfaces such that the caps are rotatable about the shafts respectively. A pattern is formed on each of the caps such that various kinds of patterns can be formed among the caps when the caps are rotated relative to the shafts respectively.

1 Claim, 4 Drawing Sheets

GAME APPARATUS

BACKGROUND OF THE INVENTION (a) Field of the Invention

The present invention relates to a game apparatus, and more particularly to a game apparatus having a spherical shape.

(b) Description of the Prior Art

Various kinds of toys and games have developed, for example, spherical game apparatus have been designed for a long time, however, the game apparatus are provided as puzzle games and the playing method can not be easily figured out such that the game apparatus can not be widely accepted.

The present invention has arisen to mitigate and/or obviate the afore-described disadvantages of the conventional game apparatus.

SUMMARY OF THE INVENTION

The primary objective of the present invention is to provide a game apparatus which can be easily played with children and adults.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
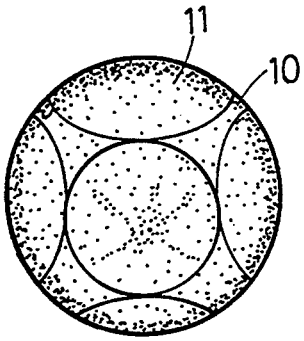
FIG. 1 is a perspective view of a game apparatus in accordance with the present invention.
Figure 3:
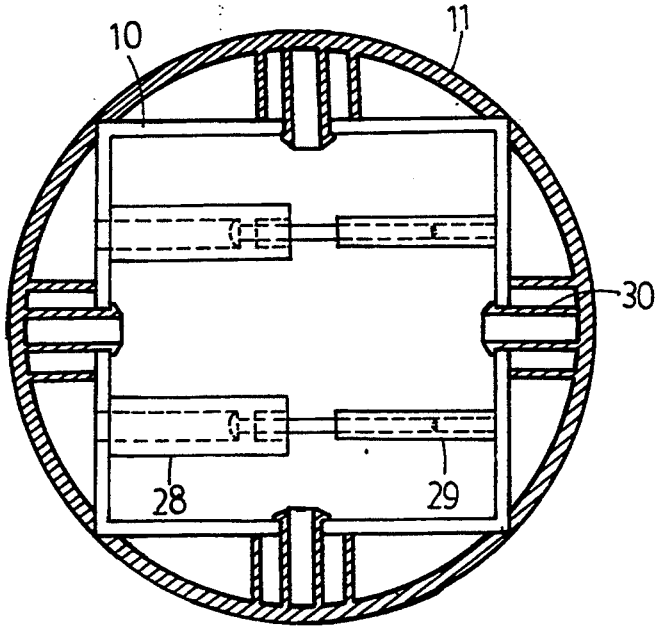
FIG. 3 is a cross sectional view of the game apparatus.
Figure 2:
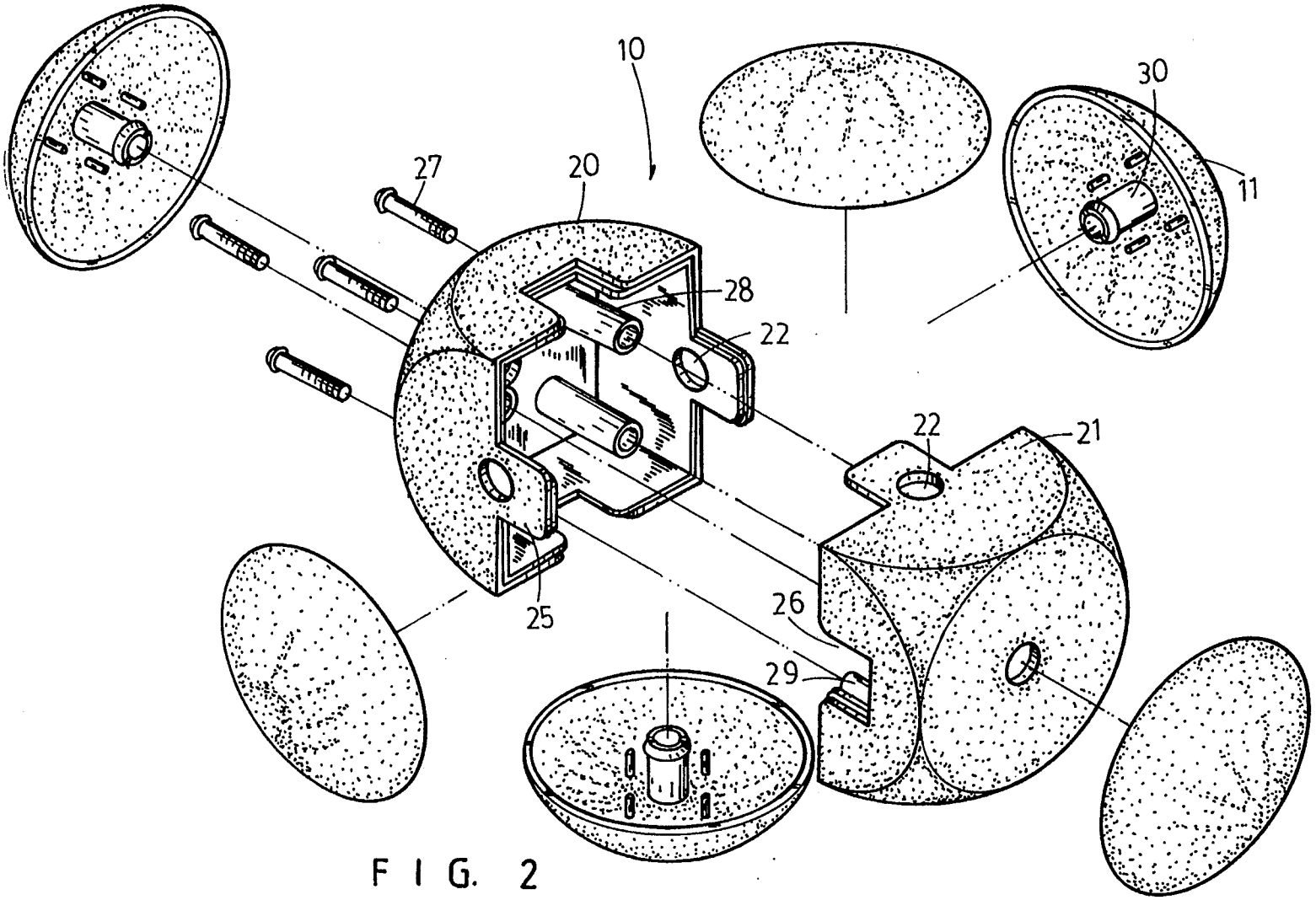
FIG. 2 is an exploded view of the game apparatus.

Referring to the drawings and initially to FIGS. 1 to 3, a game apparatus in accordance with the present invention is generally spherical and comprises a body 10 including two halves 20, 21 coupled together so as to form a body having six surfaces including three pairs of opposite surfaces, in which the sides opposite to one another are parallel in orientation, an opening 22 formed in the center of each of the six surfaces, each of the two halves 20, 21 includes two posts 28, 29 which are coupled together by bolts 27 such that the two halves 20, 21 can be coupled together, the first half 20 includes two lugs 25 engaged with the notches 26 formed in the second half 21, and the second half 21 also includes two lugs engaged with the notches formed in the first half such that the two halves 20, 21 can further be solidly coupled together. Six caps 11 each includes a shaft 30 extended radially inwards thereof for engaging with the respective openings 22 such that the caps 11 are rotatable about the respective shafts 30. The outer surfaces of the caps 11 can be printed with various kinds of patterns, for example, as shown in FIGS. 5 and 6, four curves of different diameters are formed or printed on the outer surface of each of the caps 11.

Figure 4:
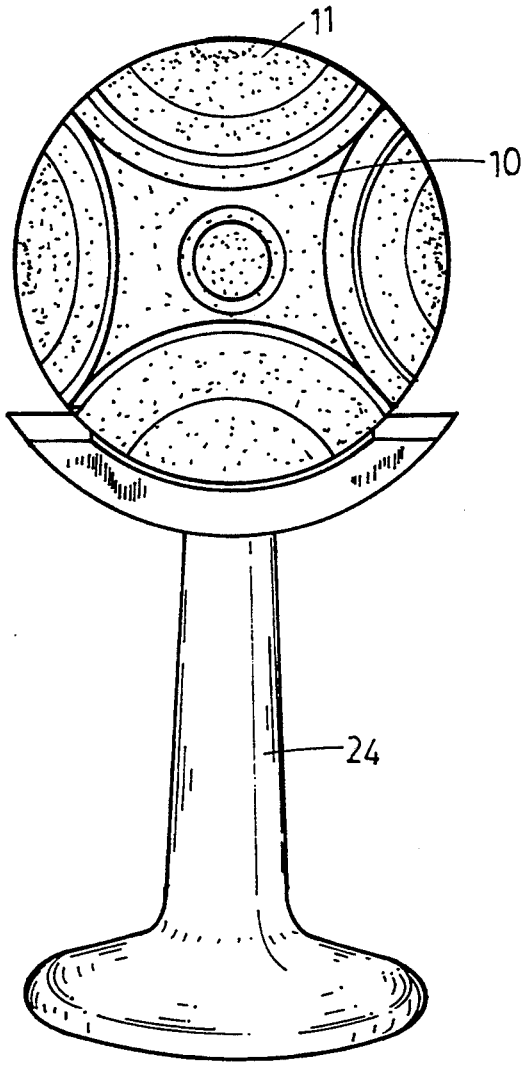
FIG. 4 is a perspective view of the game apparatus which can be used as a decorative means.

As shown in FIG. 4, the spherical game apparatus can be supported on a support 24 as a decorative means when it is not being used.

Figure 6:
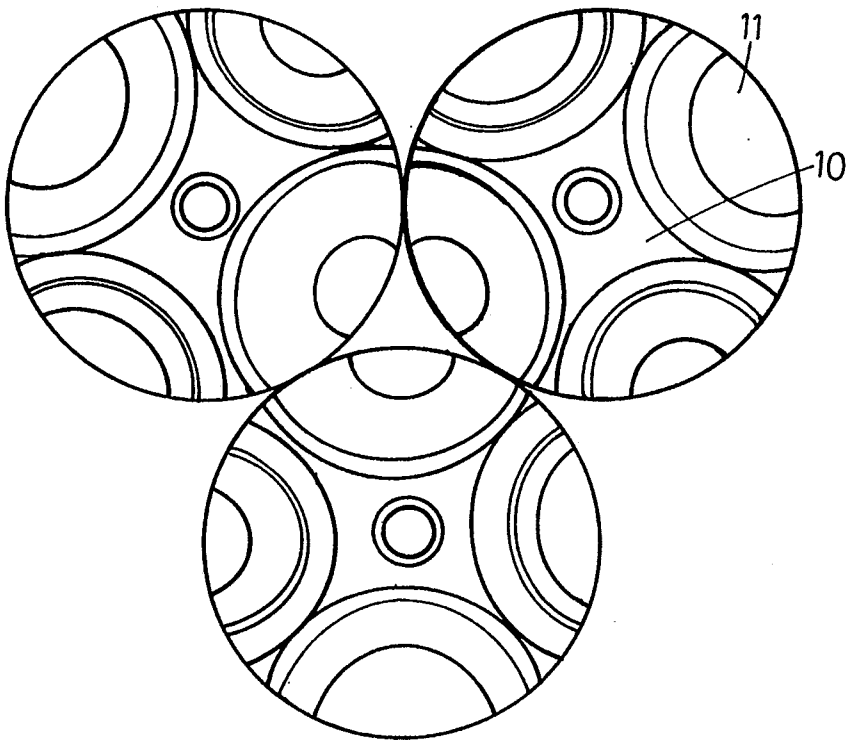
FIGS. 5 and 6 are schematic views illustrating the operations of the game apparatus.
Figure 5:
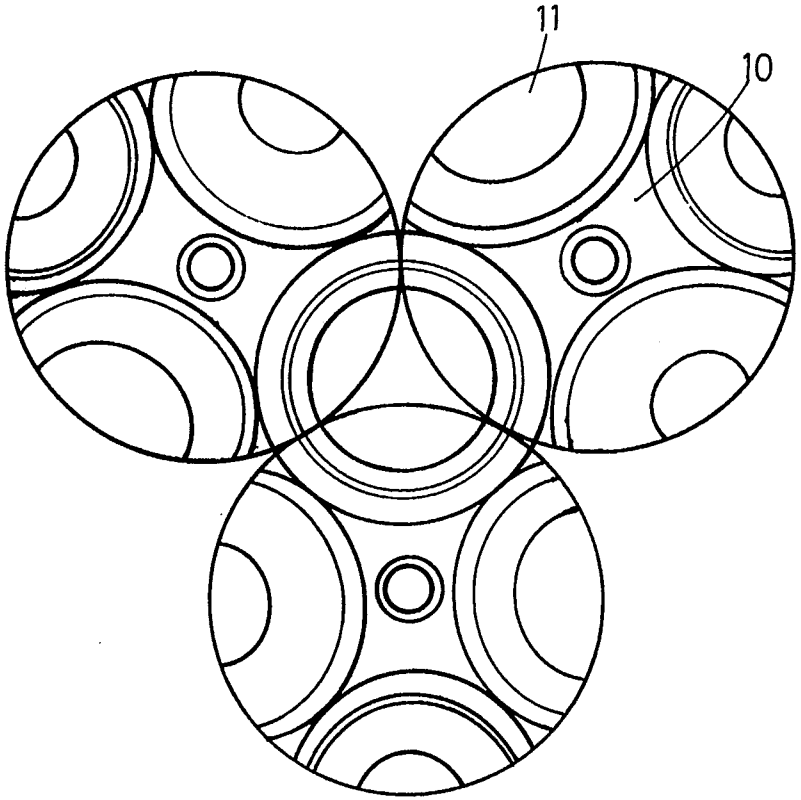

As shown in FIGS. 5 and 6, illustrated are schematic views showing three adjacent caps 11 which are expanded for illustration purposes. When the three adjacent caps 11 are rotated separately, various kinds of patterns may be formed among the patterns formed on the caps 11.

Accordingly, the game apparatus in accordance with the present invention includes a simplified configuration and can be easily played with children and adults.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A game apparatus comprising a body including three pairs of parallel and opposite surfaces, an opening formed in each of said surfaces, six caps each including a shaft extended therefrom for engaging with said openings of said surfaces such that said caps are rotatable about said shafts respectively, said body including two halves each having at least one post provided therein, said posts of said two halves being coupled together so as to couple said two halves together, said two halves including a first half having a pair of first lugs formed thereon and a pair of first notches formed therein, and a second half having a pair of second lugs formed thereon for engaging with said first notches of said first half and a pair of second notches formed therein for engaging with said first lugs of said first half so as to further couple said two halves together, and a pattern formed on an outer peripheral surface of each of said caps.

* * * * *